United States Patent [19]

Shaw

[11] Patent Number: 4,869,296

[45] Date of Patent: Sep. 26, 1989

[54] DEVICE FOR REMOVING WASTE PRODUCTS FROM TEXTILE MACHINES

[75] Inventor: Henry Shaw, Vleteren, Belgium

[73] Assignee: Picanol N.V., Ieper, Belgium

[21] Appl. No.: 185,046

[22] Filed: Apr. 22, 1988

[30] Foreign Application Priority Data

May 12, 1987 [BE] Belgium ..... 8700519

[51] Int. Cl.[4] ..... D03J 00/00

[52] U.S. Cl. ..... 139/1 C; 15/312 A

[58] Field of Search ..... 139/1 R, 1 C; 15/312 R, 15/312 A, 319, 316 R

[56] References Cited

U.S. PATENT DOCUMENTS

| | | | |
|---|---|---|---|
| 2,400,792 | 5/1946 | Turner . | |
| 3,153,803 | 10/1964 | Bahnson | 139/1 C |
| 3,163,879 | 1/1965 | Lamb | 15/312 R |
| 3,429,746 | 2/1969 | Seress et al. . | |
| 4,543,999 | 10/1985 | Deborde et al. . | |
| 4,676,277 | 6/1987 | Gillespie et al. | 139/1 C |
| 4,697,298 | 10/1987 | Mulligan | 15/312 R |

FOREIGN PATENT DOCUMENTS

| | | |
|---|---|---|
| 192014 | 2/1986 | European Pat. Off. . |
| 1205920 | 11/1965 | Fed. Rep. of Germany . |
| 1919229 | 3/1970 | Fed. Rep. of Germany . |
| 2063521 | 7/1971 | Fed. Rep. of Germany . |
| 1710296 | 10/1971 | Fed. Rep. of Germany . |
| 2815188 | 10/1979 | Fed. Rep. of Germany . |
| 584302 | 1/1977 | Switzerland . |
| 2027878 | 2/1980 | United Kingdom . |

*Primary Examiner*—Henry S. Jaudon

*Attorney, Agent, or Firm*—Bacon & Thomas

[57] ABSTRACT

A device for removing waste products from weaving machines consists essentially of two air-moving parts: a first part 9 which travels along the machine or machines to be cleaned; and a second part 10 which is mounted on the machine or machines concerned, so that the first and second parts can operate together. The parts 9, 10 establish a moving air stream or streams such that waste products are transported away from the weaving machine by the air stream(s). A single one of the parts can be moveable along different weaving machines while the other part is fixed on the weaving machines.

13 Claims, 3 Drawing Sheets

11
12
12
9
13
3
1
15
14
A
A
16
17
19
4
5
7
A
A
2
21
20
18
8
20
6
22
22
10
23
17
20

11
12
12
25
27
9
14
13
3
1
14
26
15
26
16
26
16
5
4
15
15
7
19
2
29
8
28
18
6
22
28'
17
23
20
10
17

DEVICE FOR REMOVING WASTE PRODUCTS FROM TEXTILE MACHINES

BACKGROUND OF THE INVENTION

1. Field of the Invention

This invention concerns a device for removing waste products from textile machines, i.e. a device for creating an airstream for removing dust and/or thread ends and/or similar materials from machines.

2. Description of the Related Art

It is known that on textile machines, and in particular on weaving machines, a relatively large amount of dust is generated, in particular textile dust as waste material. Obviously, such dust can interfere with the correct operation of the machine and can also cause faults in the textile, and so has to be regularly removed.

It is also known that, on such machines, thread ends are formed; these are generally collected in receptacles which have to be emptied at regular intervals.

Until now, two main types of cleaning devices have been known for removing dust, such as textile dust, from textile machines. The first type, in which the cleaning device makes up a fixed part of the textile machine concerned, is known from patents or patent applications DE No. 1,710,296; DOS No. 2,063,521; GB No. 2,027,878; U.S. Pat. No. 2,400,792; and U.S. Pat. No. 4,543,999, among others. These devices have the disadvantage of taking up lots of space in the machine. As a result—for example on weaving machines—little space is left for automatic devices, such as are becoming more and more common.

The second type uses cleaning devices which can move along the textile machines, completely independently of said machines, and which can blow away and/or suck up dust by presenting air conduits, which may or may not be movable, to the machine. Such cleaning devices are known from documents EP No. 192,014; DOS No. 1,919,229; DAS No. 2,815,188; and U.S. Pat. No. 3,429,746, among others. However, they have the disadvantage of not being able to clean parts of the machine that are difficult to reach.

SUMMARY OF THE INVENTION

The present invention concerns a completely new type of cleaning device for textile machines which avoids all the abovementioned disadvantages and which also offers the possibility of removing threads ends and the like from the recipients mentioned earlier. For this purpose, the device according to the invention consists of a two part air conduit system, namely a first part which can travel along the machine or machines to be cleaned, and a second part which is mounted on the machine or machines concerned, so that the first and second parts can operate together. This provides the advantage that the second part can be located in areas of the machine(s) that otherwise would not be accessible to the usual external cleaning hoses used in the prior art.

In the most preferred embodiment, the first part consists of a blower and/or suction device together with associated air conduits with blower and/or suction nozzles, while the second part consists essentially of air conduits which are mounted in the machine and which also have blower and/or suction nozzles, so that, when the first and second parts work together, the air conduits of the second part essentially act as extensions of a number of the air conduits of the first part. Clearly, in this way the number of components of the cleaning device incorporated in the machine concerned is reduced to a minimum, while fine dust, thread ends and suchlike can be efficiently removed from the most inaccessible places.

BRIEF DESCRIPTION OF THE DRAWINGS

For the purposes of explaining the characteristics of the invention, by way of example only and without being limitative in any way, the following preferred embodiments are described with reference to the accompanying drawings, where:

FIG. 1 is a schematic representation of a weaving machine 1, showing the most important components such as the warp beam 2, the harnesses 3 which form the shed 4, the sley 5 and the cloth beam 6. The warp threads 7 and the woven cloth 8 are also shown.

The device according to the invention consists essentially of an airstream transporting conduit system including a first part 9 and a second part 10 which can operate together as a cleaning system for a weaving machine.

Figure 4:
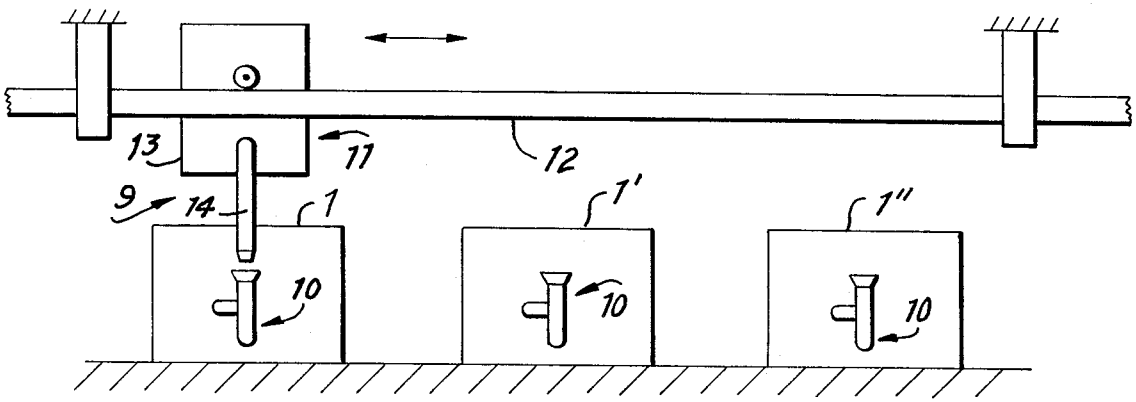
FIG. 4 illustrates the invention as used with multiple looms.

The first part 9 of the system can travel along the weaving machine 1 and can also be presented successively to several other weaving machines in a similar way, as shown in FIG. 4. The travel of the first part 9 can be, for example, by means of a transport mechanism 11 which travels along guides or rails 12 mounted above the weaving machines 1.

The first part 9 consists essentially of a blower and/or suction device 13, e.g. a compressor or an air pump, to which are connected air conduits 14 and 15 fitted respectively with blower nozzles 16 and suction nozzles 17, arranged so that the nozzles can be presented close to the weaving machine 1.

The second part 10 of the system preferably comprises a number of second air conduits 18 and 19 integrated in and around the weaving machine 1 and which are also fitted with blower nozzles 20 and/or suction nozzles 21, so that when the first part 9 of the device is presented to the weaving machine 1, the air conduits 18 and 19 of the second part 10 form extensions of the air conduits 14 and 15 of the first part 9 i.e., a continuous air-transporting conduit.

The second set of air conduits 18 and 19 of the second part 10 are of course arranged so that the blower nozzles 20 and suction nozzles 21 are appropriately situated so as to provide an airstream 22 to blow or suck away waste materials at all necessary points in the weaving machine 1. The dust and suchlike are blown out of the weaving machine 1 at the bottom and removed at the sides by at least one of the suction nozzles 17 of the first part 9, which is mounted near the floor 23.

The air conduits 14–15 and 18–19 of the first part 9 and of the second part 10 may be fitted with closures A to prevent unwanted airstreams and/or penetration of unwanted dust during the phase in which the parts 9 and 10 are not working together (i.e., when part 9 is in transit and not yet presented to part 10). The closures may take any appropriate form known to the art, including conventional valves.

Figure 2:
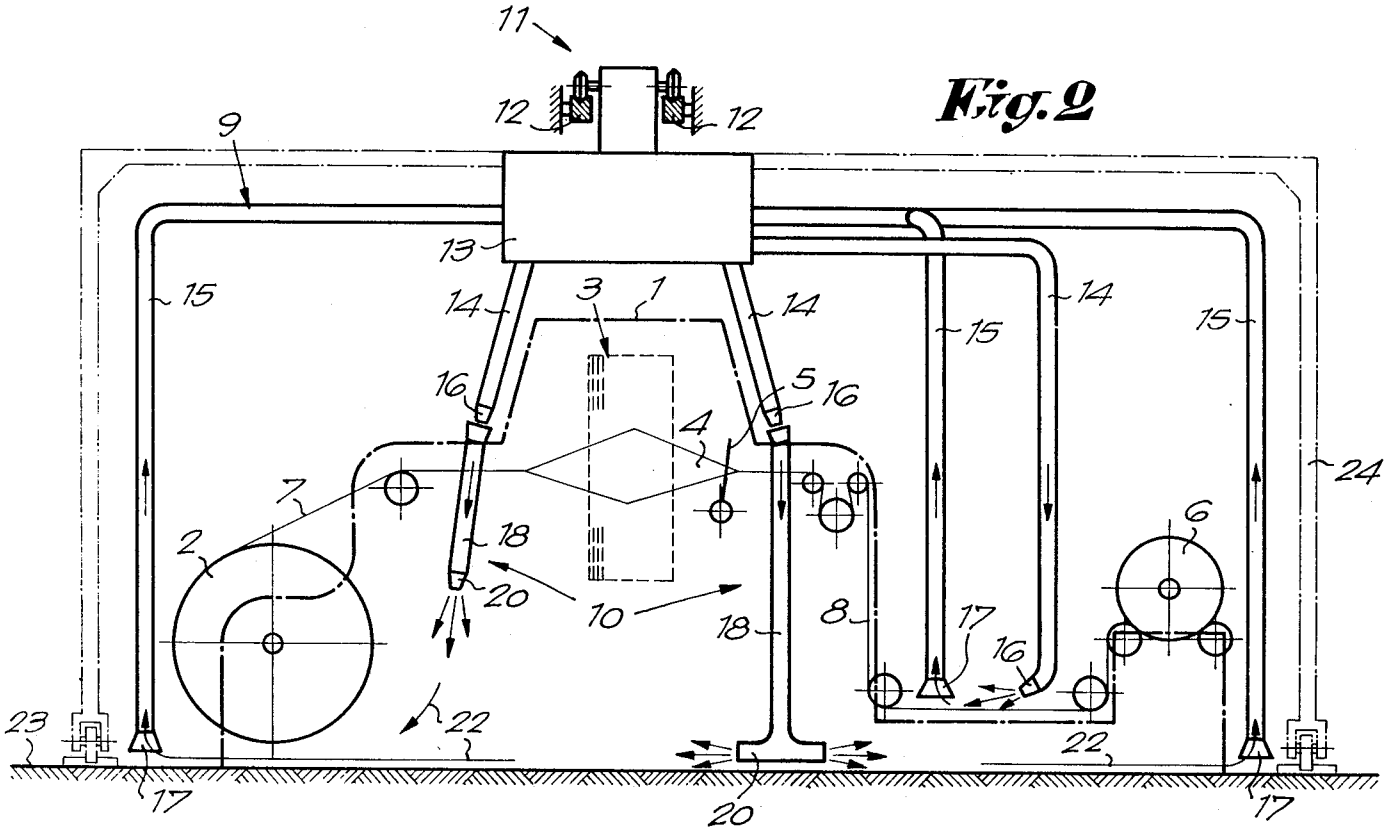

FIG. 2 shows a variant of the device according to the invention. FIG. 2 illustrates schematically how the transport mechanism 11 (shown in continuous lines) may be replaced by a transport mechanism 24 (shown in dotted lines) with a supporting structure which rolls along the floor 23. It is also possible to use rails or suchlike mounted on adjacent weaving machines.

Figure 1:
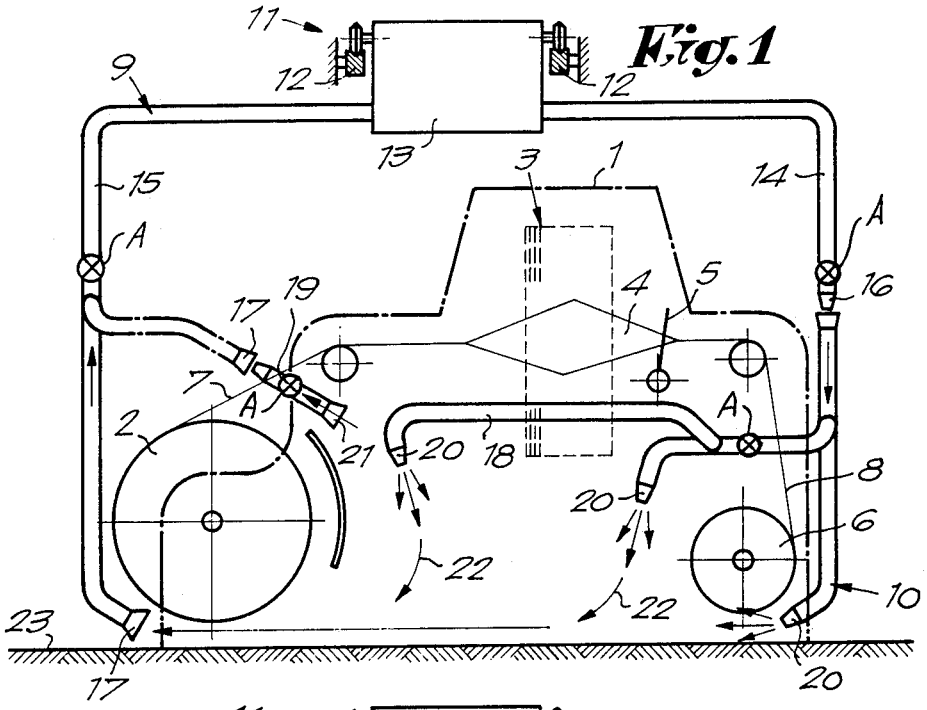
FIG. 1 is a schematic diagram of a weaving machine equipped with a device according to the invention.
Figure 3:
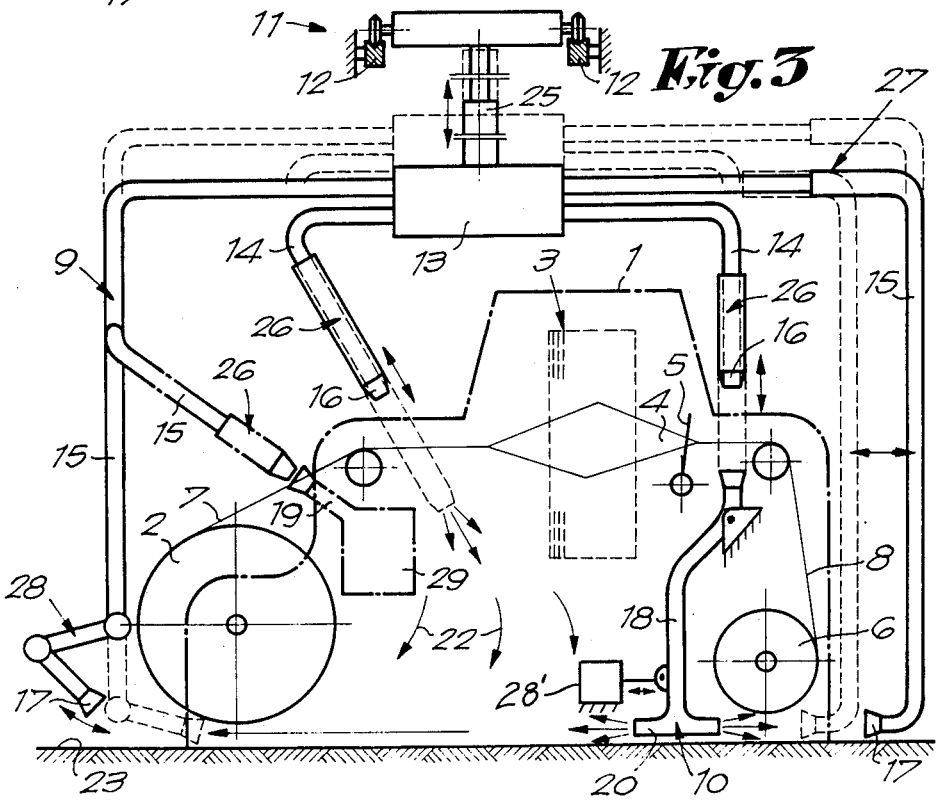
FIGS. 2 and 3 show variant embodiments of the schematic shown in FIG. 1.

In another variant, as shown in FIG. 3, the device can incorporate various displacement mechanisms which enable particular components of the first part 9 and/or the second part 10 to carry out certain movements in order to reach all parts of the weaving machine 1. Such a mechanism can for instance consist of a telescopic suspension 25 for the first part 9, or also of other telescopic joints 26, translation mechanisms 27 or rotation mechanisms 28 or 28' for the purpose of moving a number of air conduits. The displacement mechanisms may be programmed or may carry out motions guided by templates in order to perform a particular cleaning cycle.

Finally, FIG. 3 schematically illustrates a waste receptacle 29 for thread waste or suchlike which can operate with air conduit 15 of the first part 9 and which may also have a waste receptacle opening 19.

Instead of a compressor or air pump, the blower and/or suction device 13 can also consist of connections to an external compressed air or suction installation.

Clearly, the transport mechanisms 11 or 24 can provide a continuous or discontinuous movement of the first part 9, and clearly also the displacement mechanisms 25 to 28 may or may not be controlled in combination with the movement of the first part 9.

In order to obtain a better cleaning effect, the device may use air pulses. The travelling part 9 may of course carry all sorts of other equipment, for example a tying-in device.

The present invention is not limited to the embodiments described in the text and shown in the figures; on the contrary, such a device for removing waste materials on textile machines can be made in all sorts of forms and dimensions while still remaining within the scope of the invention.

I claim:

1. A cleaning system for weaving machines comprising:

a first air stream transporting conduit system arranged to be movable relative to and in close proximity to the exterior of a weaving machine, and including first air conduits and first air conduit openings disposed at selected locations adjacent the weaving machine such that the first air conduits do not interfere with the movement of the first air conduit system relative to said weaving machine;

a second air stream transporting conduit system attached to the weaving machine and including second air conduits and second air conduit openings disposed at selected locations on the weaving machine;

said first and second air stream conduit systems arranged so that at least a pair of first and second air conduit openings can be placed in communication with each other to form a continuous air transporting conduit arrangement whereby, upon circulation of an air stream in either conduit system, circulation of air is induced in the other conduit system; and air circulating means for circulating air through at least one of the conduit systems.

2. A cleaning system as claimed in claim 1 wherein said air circulating means is connected to said first conduit system.

3. A cleaning system as claimed in claim 2, wherein said air circulating means is arranged to be movable with said first conduit system.

4. A cleaning system as claimed in claim 1, wherein said first conduit system is carried by support means disposed above the weaving machine, said support means comprising a transport means arranged to carry the first conduit system along a path extending along the weaving machine.

5. A cleaning system as claimed in claim 1, said first air conduits and first conduit openings including conduits and openings extending towards the area beneath the weaving machine.

6. A cleaning system as claimed in claim 1, wherein at least one of said first air conduits is movable independently of movement of the first conduit system as a whole.

7. A cleaning system as claimed in claim 1, wherein at least one of said second air conduits is movable relative to the weaving machine.

8. A cleaning system as claimed in claim 1, wherein at least one of said first air conduits is movable independently of movement of the first conduit system as a whole, and wherein said second conduit system includes a conduit arranged to be movable relative to the weaving machine.

9. A cleaning system as claimed in claim 1, 2 or 3 including means for supporting the first air conduit system for movement from below the first conduit system along a horizontal support surface that also supports the weaving machine.

10. A cleaning system as claimed in claim 1, 2 or 3, including a receptacle for waste material supported by the weaving machine, and including a waste receptacle opening; said first air conduit system including a waste opening arranged to be movable into communication with said waste receptacle opening.

11. A cleaning system as claimed in claim 1, 2 or 3, including a closure valve means in at least one of said first air conduits for preventing circulation of air in said at least one air conduit.

12. A cleaning system as claimed in claim 11, including a closure valve means in at least one of said second air conduits for preventing circulation of air in said at least one second air conduit.

13. A cleaning system for a plurality of adjacent weaving machines comprising:

a primary air stream transporting conduit system arranged to be movable relative to and in close proximity to a plurality of adjacent weaving machines and including at least a primary air conduit and a primary air conduit opening; said first conduit system being movable so that said at least one primary air conduit opening can be disposed in close proximity to each one of said plurality of weaving machines;

a plurality of secondary air stream transporting conduit systems each attached to one of said plurality of weaving machines, and including at least one secondary air conduit and an associated secondary air conduit opening disposed at a selected location on each one of said plurality of weaving machines;

said primary and secondary air stream transporting conduit systems arranged so that the primary air conduit openings can be moved to positions so as to place them first in communication with said at least one secondary air conduit opening of a single one of said plurality of weaving machines to form a continuous air transporting conduit arrangement, whereby, upon circulation of an air stream in either the primary or secondary air conduit system, circulation of air is induced in the other air conduit system; and then in communication with the at least one secondary air conduit opening of the other ones of said plurality of weaving machines in a similar manner as said one weaving machine; and air circulating means for circulating air in at least one of the conduit systems when the primary and secondary air conduit systems are in communication with each other.

* * * * *